US008584795B1

(12) United States Patent
Buckner

(10) Patent No.: US 8,584,795 B1
(45) Date of Patent: Nov. 19, 2013

(54) FILTER SILENCER

(75) Inventor: Don M. Buckner, Okahumpka, FL (US)

(73) Assignee: Vac-Tron Equipment, LLC, Okahumpka, FL (US)

( * ) Notice: Subject to any disclaimer, the term of this patent is extended or adjusted under 35 U.S.C. 154(b) by 0 days.

(21) Appl. No.: 13/602,403

(22) Filed: Sep. 4, 2012

(51) Int. Cl.
*E04F 17/04* (2006.01)

(52) U.S. Cl.
USPC ..... 181/224; 181/222; 181/229; 181/214

(58) Field of Classification Search
USPC ..... 181/229, 214, 224, 222
See application file for complete search history.

(56) References Cited

U.S. PATENT DOCUMENTS

| | | | | |
|---|---|---|---|---|
| 2,198,021 | A | 4/1940 | Wood | |
| 2,639,601 | A | 5/1953 | Miller | |
| 3,864,064 | A | 2/1975 | Gannaway | |
| 4,111,278 | A | 9/1978 | Bergman | |
| 4,119,238 | A | 10/1978 | Ja'afar | |
| 4,334,633 | A | 6/1982 | Piegza | |
| 4,346,781 | A * | 8/1982 | Ingard et al. | 181/206 |
| 4,744,698 | A | 5/1988 | Dallimer | |
| 4,760,656 | A | 8/1988 | East | |
| 5,092,963 | A | 3/1992 | Barker | |
| 5,191,993 | A | 3/1993 | Wanger | |
| 5,196,654 | A | 3/1993 | DiFlora | |
| 5,500,976 | A | 3/1996 | Rohrbacher | |
| 5,515,625 | A | 5/1996 | Keigley | |
| 5,573,371 | A | 11/1996 | Kieffer | |
| 5,859,393 | A * | 1/1999 | Cummins et al. | 181/257 |
| 5,887,667 | A | 3/1999 | Van Zante | |
| 5,996,731 | A | 12/1999 | Czabala | |
| D423,521 | S | 4/2000 | Walter | |
| 6,360,458 | B2 | 3/2002 | Dolister | |
| 6,397,967 | B1 | 6/2002 | McIlwraith | |
| 6,499,934 | B1 | 12/2002 | Kaczmarski | |
| 6,533,064 | B1 | 3/2003 | Kim | |
| 6,550,406 | B2 | 4/2003 | Bass | |
| 6,604,304 | B1 | 8/2003 | Slabach | |
| 6,988,568 | B2 | 1/2006 | Buckner | |
| 7,383,810 | B1 * | 6/2008 | Emley | 123/198 E |
| 7,484,322 | B2 | 2/2009 | Maybury, Jr. | |
| 7,694,660 | B2 * | 4/2010 | Koss | 123/184.53 |
| 7,837,050 | B2 | 11/2010 | Maybury, Jr. | |
| 8,066,140 | B1 | 11/2011 | Young | |
| 8,240,428 | B2 * | 8/2012 | Humbad et al. | 181/224 |
| 8,307,947 | B2 * | 11/2012 | Bussow | 181/224 |
| 8,336,231 | B2 | 12/2012 | Maybury | |
| 2004/0226772 | A1 * | 11/2004 | Hirose et al. | 181/258 |
| 2004/0231912 | A1 * | 11/2004 | Fukumoto | 181/249 |
| 2005/0023077 | A1 * | 2/2005 | Sishtla | 181/252 |
| 2005/0178111 | A1 * | 8/2005 | Kammel | 60/289 |
| 2006/0032095 | A1 | 2/2006 | Buckner | |

(Continued)

*Primary Examiner* — Forrest M Phillips
(74) *Attorney, Agent, or Firm* — McKinney Law, PLLC

(57) ABSTRACT

A filter silencer is disclosed. In a particular embodiment, the silencer includes a housing, a silencer chamber disposed inside the housing, and a filter chamber disposed between a sidewall of the housing and the silencer chamber. An intake port is in communication with the filter chamber and ambient air. The filter chamber also includes a filter chamber outlet that is in communication with a compressor or air blower, for example. A silencer chamber inlet is in communication with an exhaust of the compressor or air blower, where an air flow is forced through the silencer and out a discharge port. The discharge port and the intake port are at opposing ends of the silencer. In addition, the silencer includes at least one baffle secured within the silencer chamber, where the baffle is configured to generate a non-directional interference with the air flow to assist in silencing the discharge.

15 Claims, 3 Drawing Sheets

(56) References Cited

U.S. PATENT DOCUMENTS

| | | | | |
|---|---|---|---|---|
| 2006/0117612 | A1 | 6/2006 | Maybury, Jr. | |
| 2006/0182591 | A1 | 8/2006 | Hackett | |
| 2008/0120961 | A1* | 5/2008 | Meier et al. | 60/274 |
| 2009/0188217 | A1* | 7/2009 | Amann | 55/323 |
| 2010/0320204 | A1 | 12/2010 | Maybury, Jr. | |
| 2011/0088289 | A1 | 4/2011 | Maybury, Jr. | |

* cited by examiner

FIG. 3
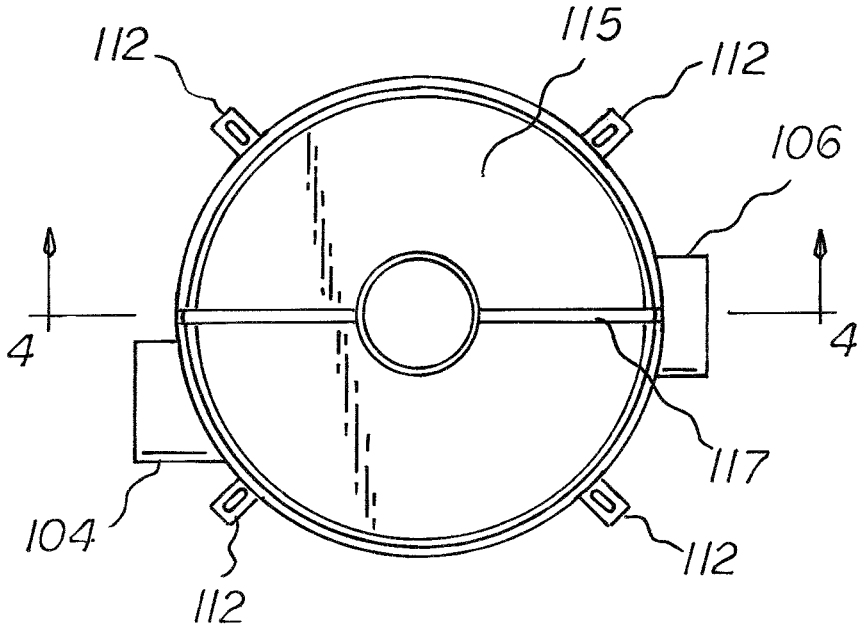
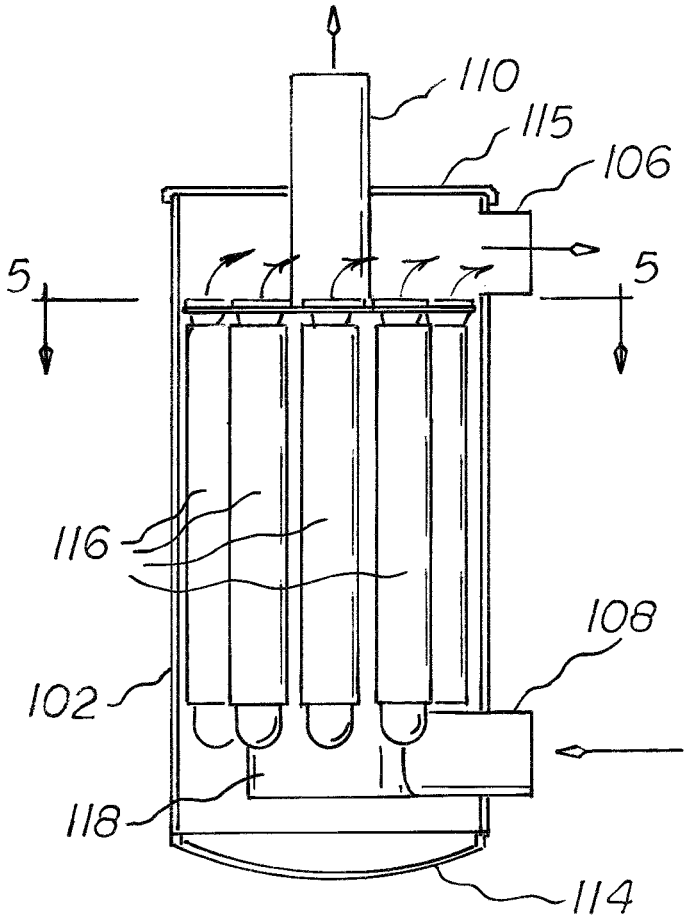
FIG. 4

FIG. 5
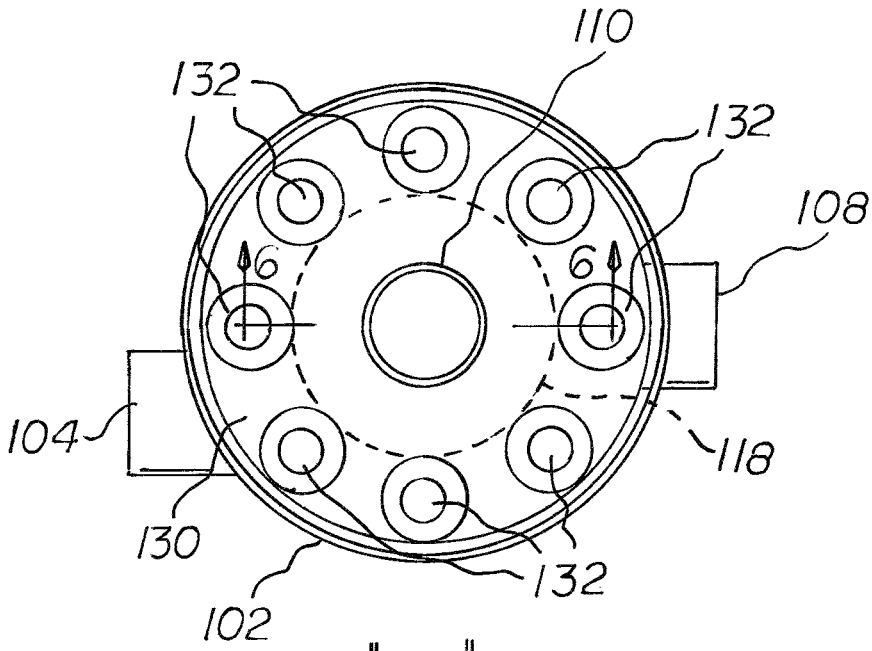
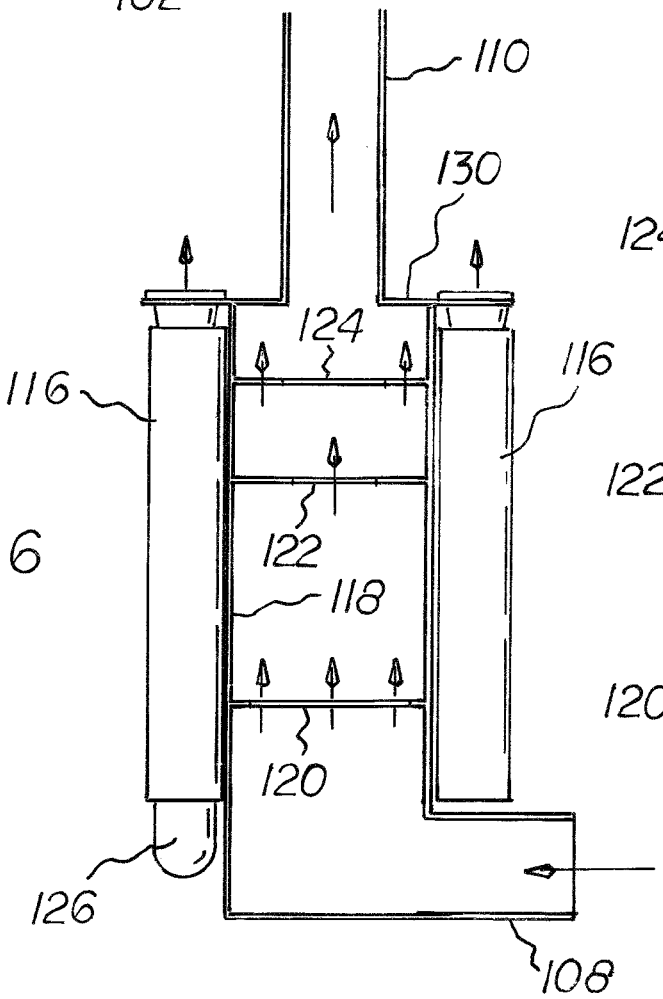
FIG. 6
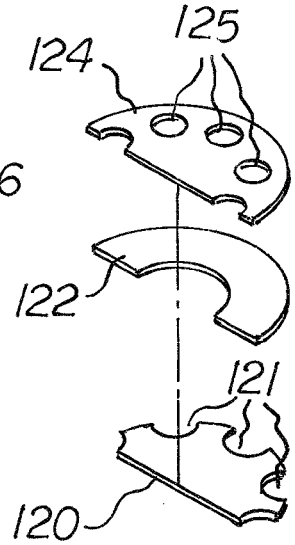
FIG. 6A

FILTER SILENCER

I. FIELD

The present invention relates in general to reducing noise levels through a filter silencer.

II. DESCRIPTION OF RELATED ART

Most air compressors and air blowers have a fixed replaceable filter installed prior to an air inlet and sometimes a muffler is placed on an air outlet of the equipment in an attempt to reduce noise levels. The two operate independent of each other. For example, compressors will incorporate an intake filter, which will by itself give some noise attenuation. However, this may be insufficient, in which case an intake silencer may be needed. An intake silencer may be reactive or absorbent or both according to the frequency of the noise. For frequencies above 125 Hz, absorptive silencers are required and for frequencies below 125 Hz, reactive silencers are appropriate. If the 125 Hz band is straddled, then a combination silencer can be used.

A reactive silencer produces its effect by interference and reflection of the sound waves. A simple silencer would include an expansion chamber with a pipe, which may be sufficient by itself if one frequency dominates the spectrum. The lower the frequency that is to be suppressed, the larger the housing that is required.

An absorptive silencer produces its effect by suppressing internal reflections with a porous acoustic material lining the inside of the silencer chamber. When using this type of silencer, precautions must be taken to ensure that the material does not become contaminated by dust, water or oil which will not only reduce its effectiveness but may also be a fire hazard.

Another type of reactive silencer is the venturi tube, which is particularly effective but expensive. The main advantage of a venturi is that the pressure drop is lower than with other kinds of restrictions, so it is particularly suitable for intake silencers where intake pressure losses could seriously affect the compressor efficiency. The flow velocity can be higher than with other silencers.

Therefore, a need exists in the art for a silencer that is effective in reducing noise levels while at the same time reduces the overall space requirements for intake and exhaust of equipment and is self cleaning to reduce the fire hazard. In addition, there is a need for a filter silencer that does not affect the equipment efficiency.

However, in view of the prior art at the time the present invention was made, it was not obvious to those of ordinary skill in the pertinent art how the identified needs could be fulfilled.

III. SUMMARY

In a particular embodiment, a filter silencer is disclosed. The filter silencer includes a housing, a silencer chamber disposed inside the housing, a filter chamber disposed between a sidewall of the housing and the silencer chamber, an intake port in communication with the filter chamber and ambient air, a filter chamber outlet, a silencer chamber inlet, and a discharge port. The filter chamber outlet is adapted to be in communication with an inlet of an air compressor or air blower, for example, and the silencer chamber inlet is adapted to be in communication with an outlet of the air compressor or the air blower. The air flow entering through the filter is in the same direction as the air flow exhausting separately through the silencer chamber.

In addition, the silencer may include at least one baffle inside the silencer chamber, where the at least one baffle further comprises a plurality of apertures along a periphery of the at least one baffle. The filter chamber may also include a plurality of air filters and a filter support plate to secure the plurality of air filters about the silencer chamber. The silencer chamber inlet is disposed proximate a first end of the silencer chamber and the discharge port is proximate a second end of the silencer chamber. The silencer chamber is configured to impart a vibration motion to the plurality of filters from the air flow along a length of the silencer chamber. Further, the silencer includes a bottom compartment to collect debris vibrated from the plurality of filters. A mechanical vibrator may also be used to shake the debris from the plurality of filters.

In another particular embodiment, the filter may include a filter cartridge, a bag filter, a pleated filter, packed fiberglass filter, or any combination thereof. In addition, the filter silencer may include a second baffle downstream of the first baffle and a third baffle downstream of the second baffle, where the baffles are configured to interfere with the flow of air. The silencer chamber may also include acoustic packing material to assist in reducing noise levels.

Other aspects, advantages, and features of the present disclosure will become apparent after review of the entire application, including the following sections: Brief Description of the Drawings, Detailed Description, and the Claims.

IV. BRIEF DESCRIPTION OF THE DRAWINGS

FIG. 3 is a top view of the filter silencer taken on line 3-3 of FIG. 1;

FIG. 4 is a sectional elevational view taken on line 4-4 of FIG. 3, showing an interior of the filter chamber;

FIG. 5 is a sectional top view taken on line 5-5 of FIG. 4, showing the filter chamber;

FIG. 6 is a sectional view taken on line 6-6 of FIG. 5, showing a silencer chamber; and FIG. 6A is a perspective sectional view of baffles within the silencer chamber.

V. DETAILED DESCRIPTION

The filter silencer disclosed herein provides a common container to house both an inlet air filter portion and a discharge air silencer portion. This common container or housing condenses the area needed to house the filter and silencer and allows complementary qualities of each to assist the other. The sound emitted from the air exhaust is transmitted as vibrations or harmonics, which are used to vibrate a filter thus vibrating debris off the surface of the filter. This creates a self-cleaning filter system.

Any filter suitable to the application may be used, for example filter cartridges, bag filters, pleated filters, packed fiberglass filter, etc. Desiccants may also be added to the filter portion to remove water from the air before the air enters the blower or compressor. The filter portion or chamber provides dampening thus assisting the silencer by reducing the sound emitted from the container. Baffles may be added to the silencer portion to control airflow and reduce noise. Acoustic materials may also be added to the silencer portion to reduce noise. Insulation may be added to either the filter or silencer portions or insulation may cover the outside of the container to further control noise and temperature. Air to air heat exchangers or air to liquid heat exchangers may be added to either chamber or to the overall container to control temperature and assist in noise control.

Figure 1:
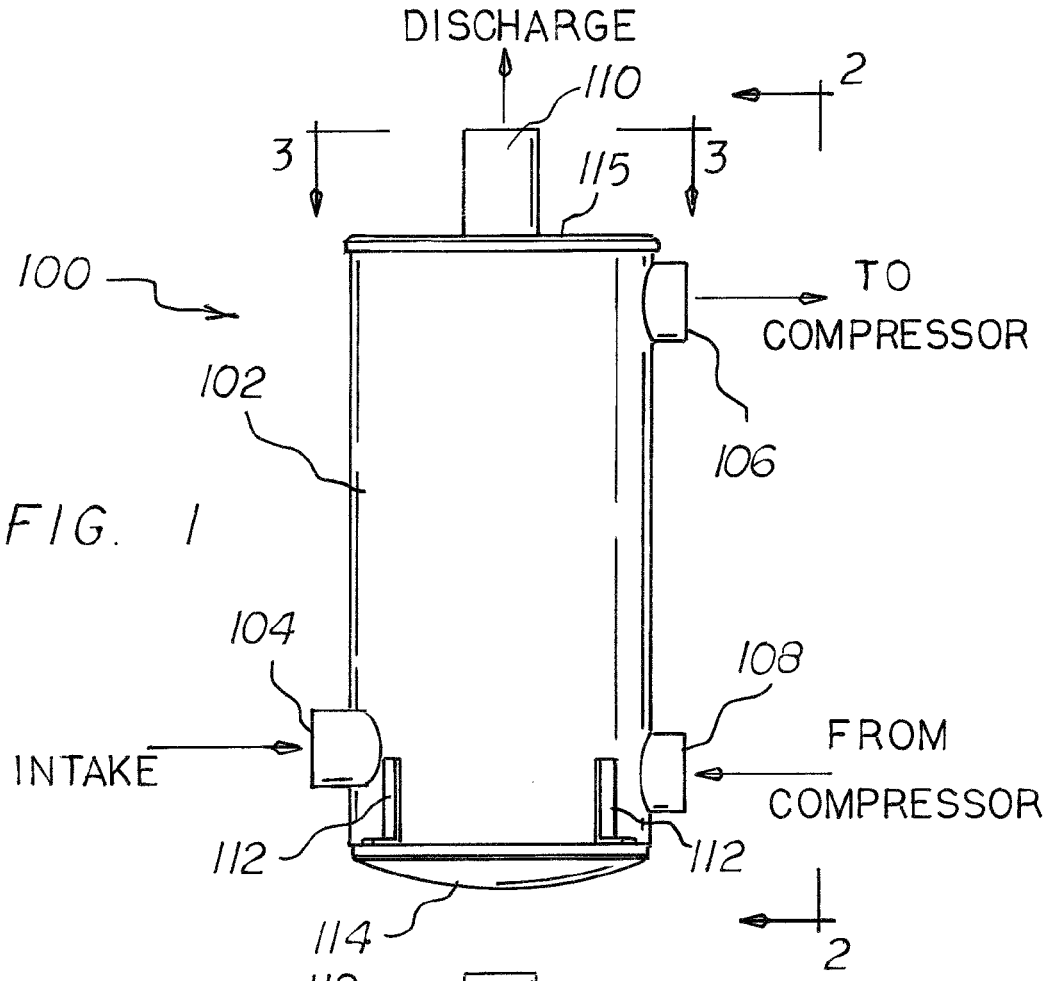
FIG. 1 is a front elevational view of one embodiment of a filter silencer, where the flow path is indicated by arrows.
Figure 2:
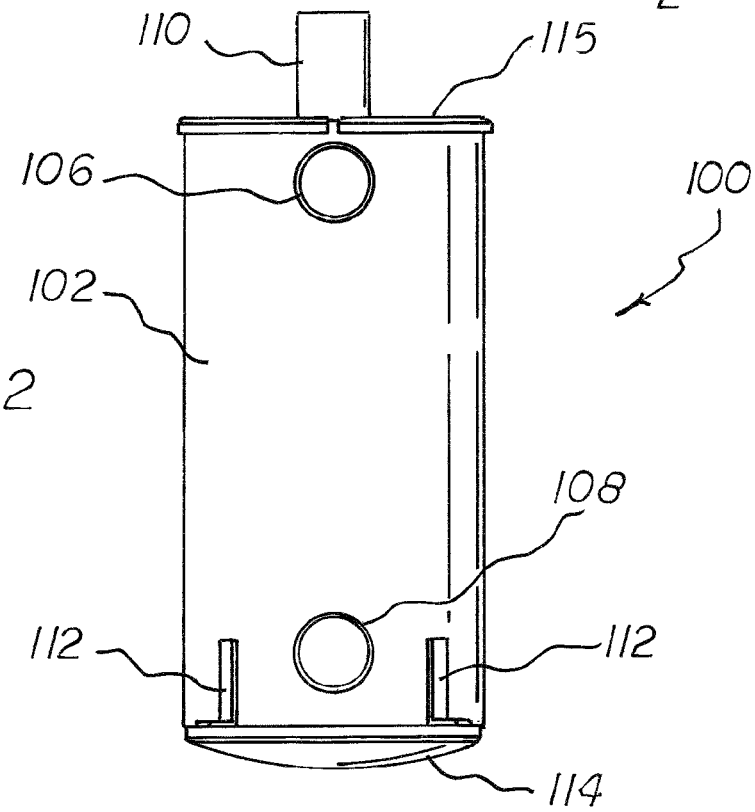
FIG. 2 is right side view of the filter silencer taken on line 2-2 of FIG. 1.

Referring now to FIG. 1, a particular embodiment of the filter silencer is disclosed and generally designated 100. The silencer 100 includes a housing 102 that may generally be cylindrical in shape, as shown in FIGS. 1-3, and includes a filter portion and a silencer portion housed therein. An intake port 104 is located proximate a bottom end of the housing 102. The intake port 104 draws ambient air into the filter silencer 100 where the air flows through the filter portion of the silencer 100 and out through an outlet 106. The silencer 100 includes a bottom portion 114 that is configured to collect debris and can be accessed to remove the debris from the filter silencer 100. The filter portion is described below and shown in FIG. 4. The two portions complement each other by the filter portion providing acoustic qualities for the silencer portion and the silencer portion providing harmonic vibration to the filter portion for filter cleaning assistance.

As the filtered air exits the silencer 100, the air may then flow to a piece of equipment such as an air compressor or an air blower, for example, which is creating the vacuum within the filter portion of the silencer 100. The exhaust air from the equipment then returns to the filter silencer 100 through a silencer chamber inlet 108. The air re-enters the silencer 100 at a higher pressure than when it exited out the filter portion through outlet 106. The high pressure air flow passes through the silencer portion of the filter silencer 100 and out through a discharge port 110. The silencer portion reduces the noise level of the air as it is discharged, which is described below in more detail and in reference to FIGS. 6 and 6A.

A series of brackets 112 are disposed proximate a bottom of the housing 102. The brackets 112 allow for the filter silencer to be easily mounted to a trailer or a truck, for example. A top 115 of the filter silencer 100 is adapted to be opened to service the filter portion. The silencer 100 in this particular embodiment is cylindrical, however, other cross sectional shapes of the silencer 100 are contemplated such as square, elliptical, and octagon, for example.

The filter portion of the silencer 100 is shown in FIG. 4 in a partial cut-away view. Filters 116 are located around the center silencer portion, which is shown in FIG. 6. In this particular embodiment, cartridge filters 116 are used as the filtering means. An annular space is formed between the center silencer portion and a sidewall of the housing 102. The air flow through the filter portion is separate from the air flow of the silencer portion. In operation, air enters the filter portion through intake port 104 (see FIGS. 1-3). Air is drawn up through the through the filters 116 and the filtered air exits at the top of the filters 116. From there, the air flows out of the silencer 100 through outlet 106. As explained above, outlet 106 is connected to equipment, such as an air compressor, which provides the vacuum to pull the air through the filter portion of the silencer 100. The equipment then imparts energy to the air and returns the higher pressure air to the silencer 100 through silencer chamber inlet 108. The bottom 114 is cup shaped to collect debris that is cleaned or shaken from the filters 116. Harmonics created by the silencer portion vibrate refuge and debris from the filters 116 to create a self-cleaning filter system.

Accordingly, the filters 116 are capable of self-cleaning of filtered refuge and debris when vibrated. The filters 116 may be vibrated by harmonics created by the silencer portion. In addition to the harmonics, the filters may be vibrated by a mechanical vibrator 126 as shown in FIG. 4, which may be a piston vibrator, a ball vibrator, a rotary vibrator, or other similar mechanical vibrator. The filters 116 may also be accessed through the top 115 to service the filters 116.

Moving to FIG. 5, a top view of the filter portion is shown. The intake port 104 is located on a side of the housing 102, where ambient air is drawn into the filter portion. A filter support plate 130 secures the filters 116 in a generally vertical orientation inside the housing 102. In operation, the ambient air enters the filter portion through the intake port 104 and passes through the filter media where refuge and debris are captured in the filter media. The filtered air travels upward through each filter 116 and out a respective aperture 132 in the support plate 130. The filter portion is formed between an inner sidewall of the housing 102 and an outer sidewall of the silencer portion 118.

Referring now to FIGS. 6 and 6A, the air enters the inlet 108 of the silencer chamber 118 where the flow is disbursed through a first baffle 120 into several small jet flows generated by semi-circular apertures 121 within the first baffle 120. This provides for quiet flow of the air into the silencer chamber 118 and the first stage of the silencing chamber 118. The first baffle 120 also directs the flow toward the outer walls of the silencer chamber 118. The air then repeats the same process contracting and expanding through a second baffle 122 having a central aperture. The second baffles 122 reacts with the noise the same way as the first baffle 120 dissipating and absorbing the noise that is left over. The second baffle 122 also has an important function as a reflow area. It allows for an even flow of air to a third baffle 124 and to the outlet 110. The third baffle includes apertures 125 that are offset from the semi-circular apertures 121 of the first baffle 120. This assures the quiet release of air through an adequately sized outlet 110.

The silencer chamber 118 may be lined with acoustic material, which is efficient in absorbing medium and high frequency noise. The strategically placed dissipative openings on the baffles 120, 122, 124 where there is no acoustical material will absorb low frequency noise. Accordingly, the silencer 100 is effective to reduce noise levels for both low and high frequency noise.

An air to air or air to liquid heat exchanger may also be attached to the filter portion, silencer portion, the housing 102, or any combination thereof. A dehydrator media may also be disposed within the filter portion to remove moisture from the ambient air.

The previous description of the disclosed embodiments is provided to enable any person skilled in the art to make or use the disclosed embodiments. Various modifications to these embodiments will be readily apparent to those skilled in the art, and the principles defined herein may be applied to other embodiments without departing from the scope of the disclosure. Thus, the present disclosure is not intended to be limited to the embodiments shown herein but is to be accorded the widest scope possible consistent with the principles and novel features.

What is claimed is:

1. A filter silencer, the silencer comprising:

a housing;

a silencer chamber disposed inside the housing and having an open end to discharge exhaust air from an air compressor or air blower;

a filter chamber disposed between a sidewall of the housing and the silencer chamber;

an intake port in communication with the filter chamber;

a filter chamber outlet in communication with the filter chamber and an inlet of the air compressor or the air blower;

at least one filter disposed between the intake port and the filter chamber outlet and configured to filter air flowing to the inlet of the air compressor or the air blower;

a silencer chamber inlet in communication with the silencer chamber and an outlet of the air compressor or the air blower to receive the exhaust air from the air compressor or the air blower; and a discharge port at the open end of the silencer chamber to discharge the exhaust air from the air compressor or the air blower through the silencer chamber.

2. The silencer of claim 1, further comprising at least one baffle inside the silencer chamber.

3. The silencer of claim 2, further comprising:

a filter support plate to secure the at least one air filter about the silencer chamber.

4. The silencer of claim 3, wherein the silencer chamber inlet is disposed proximate a first end of the silencer chamber and the discharge port is proximate a second end of the silencer chamber.

5. The silencer of claim 4, wherein the silencer chamber is configured to impart a vibration motion to the at least one filter from the exhaust air being discharged through the silencer chamber to clean the at least one filter.

6. The silencer of claim 5, the housing further comprising a bottom compartment to collect debris vibrated from the plurality of filters.

7. The silencer of claim 6, further comprising a mechanical vibrator to shake the debris from the plurality of filters.

8. The silencer of claim 7, wherein the at least one baffle further comprises a plurality of apertures along a periphery of the at least one baffle.

9. The silencer of claim 1, wherein the at least one filter is a filter cartridge, a bag filter, a pleated filter, packed fiberglass filter, or any combination thereof.

10. The silencer of claim 2, the silencer chamber further comprising a second baffle downstream of the first baffle, wherein the second baffle is configured to interfere with a flow of exhaust air.

11. The silencer of claim 10, the silencer chamber further comprising a third baffle downstream of the second baffle, wherein the third baffle is configured to interfere with the flow of the exhaust air.

12. The silencer of claim 11, wherein the intake port and the discharge port are at opposing ends of the silencer.

13. The silencer of claim 12, the silencer chamber further comprising acoustic packing material.

14. The silencer of claim 13, wherein the air flow through the filter chamber is separate from the air flow through the silencer chamber.

15. A filter silencer, the silencer comprising:

a housing;

a silencer chamber disposed inside the housing;

a filter chamber disposed between a sidewall of the housing and the silencer chamber to filter intake air for an air compressor or an air blower, wherein air flow between the silencer chamber and the filter chamber is separate through the housing; and a discharge port at an open end of the silencer chamber to discharge exhaust air from the air compressor or the air blower from the silencer chamber.

* * * * *